US005879276A

United States Patent [19]

Miller

[11] Patent Number: 5,879,276

[45] Date of Patent: Mar. 9, 1999

[54] TWISTING, PLYOMETRIC, CARDIOVASCULAR EXERCISE APPARATUS

[75] Inventor: Kenneth Miller, New York, N.Y.

[73] Assignee: Mass.Fitness, LLC, Weston, Mass.

[21] Appl. No.: 850,905

[22] Filed: May 2, 1997

Related U.S. Application Data

[63] Continuation-in-part of Ser. No. 708,867, Sep. 4, 1996, abandoned.

[51] Int. Cl.[6] ..... A63B 22/14

[52] U.S. Cl. ..... 482/146; 482/131; 482/132

[58] Field of Search ..... 482/51, 52, 71, 482/78, 79, 80, 110, 112, 131, 132, 139, 146–148, 907, 908; 601/23, 27, 29, 31–34, 84, 89, 90, 92, 97, 98, 112; 273/449, 110; 472/1, 21, 19, 14, 25, 26, 40, 37; 434/258, 260, 261; D21/191, 193, 686–690; 280/1.22; 446/288, 290

[56] References Cited

U.S. PATENT DOCUMENTS

| | | | |
|---|---|---|---|
| 858,624 | 7/1907 | Reckweg | 472/37 |
| 879,143 | 2/1908 | Cantrovitz | 472/37 |
| 2,447,203 | 8/1948 | O'Toole | 472/14 |
| 2,509,944 | 5/1950 | Skelley | 472/37 |
| 2,785,896 | 3/1957 | Ellis | 472/40 |
| 3,911,907 | 10/1975 | Smith, Jr. . | |
| 4,220,329 | 9/1980 | Agyagos . | |
| 4,290,601 | 9/1981 | Mittelstadt | 482/146 |
| 4,396,189 | 8/1983 | Jenkins . | |
| 4,538,807 | 9/1985 | Rice . | |
| 4,618,145 | 10/1986 | Inada . | |
| 4,638,996 | 1/1987 | Simjian . | |
| 4,673,180 | 6/1987 | Rice . | |
| 4,905,994 | 3/1990 | Hartz | 482/146 |
| 5,112,045 | 5/1992 | Mason et al. . | |
| 5,125,880 | 6/1992 | Peters . | |
| 5,284,461 | 2/1994 | Wilkinson et al. . | |
| 5,344,376 | 9/1994 | Bostic et al. . | |
| 5,366,430 | 11/1994 | Yao . | |
| 5,399,140 | 3/1995 | Klippel . | |
| 5,415,589 | 5/1995 | Hall, Jr. . | |
| 5,433,690 | 7/1995 | Gilman . | |
| 5,453,065 | 9/1995 | Lien et al. . | |
| 5,582,567 | 12/1996 | Chang . | |

FOREIGN PATENT DOCUMENTS

| | | | |
|---|---|---|---|
| 0878321 | 7/1981 | U.S.S.R. . | |
| 1600808 | 10/1990 | U.S.S.R. . | |
| 2144646 | 3/1985 | United Kingdom | 482/142 |

*Primary Examiner*—Jeanne M. Clark
*Attorney, Agent, or Firm*—Pennie & Edmonds LLP

[57] ABSTRACT

Apparatus for exercising a user's muscles and providing the user with a cardiovascular workout. The exercise apparatus includes a base having two concentric circular closed tracks and a platform for supporting the user, wherein the platform comprises a turntable and four rollers which glide along the tracks of the base. The platform is adapted to rotate about a first axis and to concurrently move linearly along a second axis. The exercise apparatus optionally includes a resistance mechanism for opposing movement of the platform. Also optionally included is a hand rail surrounding the platform which may be detached from the base when the apparatus is not in use.

16 Claims, 3 Drawing Sheets

TWISTING, PLYOMETRIC, CARDIOVASCULAR EXERCISE APPARATUS

This is a continuation-in-part of application Ser. No. 08/708,867 filed Sep. 4, 1996, which is incorporated herein by reference.

BACKGROUND

The present invention relates generally to an exercise apparatus and more particularly an apparatus for exercising the entire body, including arm, trunk, and leg muscles, while providing for cardiovascular exercise through continuous total body movement.

The importance of exercise has been recognized, and many now seek the benefits of a total body workout, including cardiovascular exercise and plyometric exercise. Cardiovascular exercise involves the heart and the blood vessels, and plyometric exercise enables a muscle to reach maximal strength in as short a time as possible. Both cardiovascular and plyometric exercises are useful in a wide variety of sports. Plyometric exercises are especially useful in sports that require exertion of maximal force during high-speed movements.

To get a total body workout, one can go to a gym and rotate amongst numerous exercise machines. However, gyms can be expensive, and many people do not have the time to visit one regularly. Many people therefore prefer the convenience of exercising at home. However, not only is it more difficult to get a total body workout in most homes due to space and equipment limitations, the range of movements provided for by home exercise equipment is often severely limited and therefore monotonous and boring. There is a need for total body exercise equipment that may be used in the home as well as in a gym and that is fun as well as effective.

The benefits of exercise through jumping and twisting motions have been recognized. For example, U.S. Pat. No. 5,433,690 to Gilman discloses an exercise apparatus which includes a supporting base and a rotatable platform. The platform has a fence over which the person jumps from side to side, and the degree of rotation of the platform is controlled by the user. Although the user of this apparatus enjoys a certain degree of bodily freedom, the apparatus still imposes significant restrictions to body movement. Specifically, the user must grasp a hand held support not only for stabilization but also to rotate the platform. Therefore, movement of the user's arms and upper body is largely limited during exercise. In addition, the impact resulting from the jumping motions takes a physical toll on the joints of the body, particularly in the knees.

A device directed toward exercise through rotational movement is disclosed in U.S. Pat. No. 5,344,376 to Bostic et al. The Bostic device discloses an exercise apparatus having a turntable rotatably mounted on a base, and right and left poles pivotally mounted on the base. A user stands on the turntable and swivels his hips to rotate the turntable and reciprocally pushes and pulls the poles against resistance provided by an adjustable resistance mechanism. The turntable has only one degree of freedom, and the range of movement contemplated by this apparatus is limited.

There are also a number of prior art devices that are directed toward an exercise machine that builds torso muscles through rotational movement. For example, U.S. Pat. Nos. 4,538,807 and 4,673,180 to Rice disclose an exercise machine including a stationary base, a rotatable turntable mounted on the base, having a single degree of freedom about its vertical axis, and an upright stanchion mounted on the base for a user to grasp. This device focuses mainly on the muscles of the torso, and minimal attention is paid to other muscles of the body and to cardiovascular exercise.

None of the devices discussed above provides for the particular combination of muscle strengthening, cardiovascular workout, and significant freedom of bodily movement. Thus, there is a need for such an apparatus.

OBJECTS AND SUMMARY OF INVENTION

It is an object of the present invention to provide an apparatus that provides for strengthening muscles in combination with a cardiovascular workout.

A further object of the present invention is to provide an apparatus that allows a user significant freedom of movement so that the user may have fun while exercising. A further related object of the present invention is to provide a method of exercise that does not become monotonous.

A further object of the present invention is to provide an apparatus that is safe and easy to use. Specifically, it is an object to provide an apparatus that may be used for long term exercise without injury to the body.

These and other objects are achieved according to the present invention by an apparatus for muscle strengthening and cardiovascular exercise. Briefly summarized, this apparatus has two major elements: a platform for supporting a user, which is adapted to rotate about an axis and to concurrently move vertically or linearly along the same axis; and a base for supporting the platform. Optionally, this apparatus also may be provided with a resistance means for opposing movement of the platform. There are various resistance means known in the art which are easily adaptable to the present invention. This apparatus also may be provided with a rail which the user may opt to use for additional support.

During exercise, the user stands on the platform and by making both jumping and twisting movements, moves the platform rotationally about an axis and vertically or linearly along the same axis. The platform provides complete support for the user during exercise. For additional support, the user may grasp a rail, which may be detached from the base when the apparatus is not in use.

BRIEF DESCRIPTION OF THE DRAWINGS

Reference is next made to a brief description of the drawings, which are intended to illustrate the exercise apparatus according to the present invention. The drawings and detailed description which follow are intended to be merely illustrative, and are not intended to limit the scope of the invention as set forth in the appended claims.

DETAILED DESCRIPTION

Figure 1:
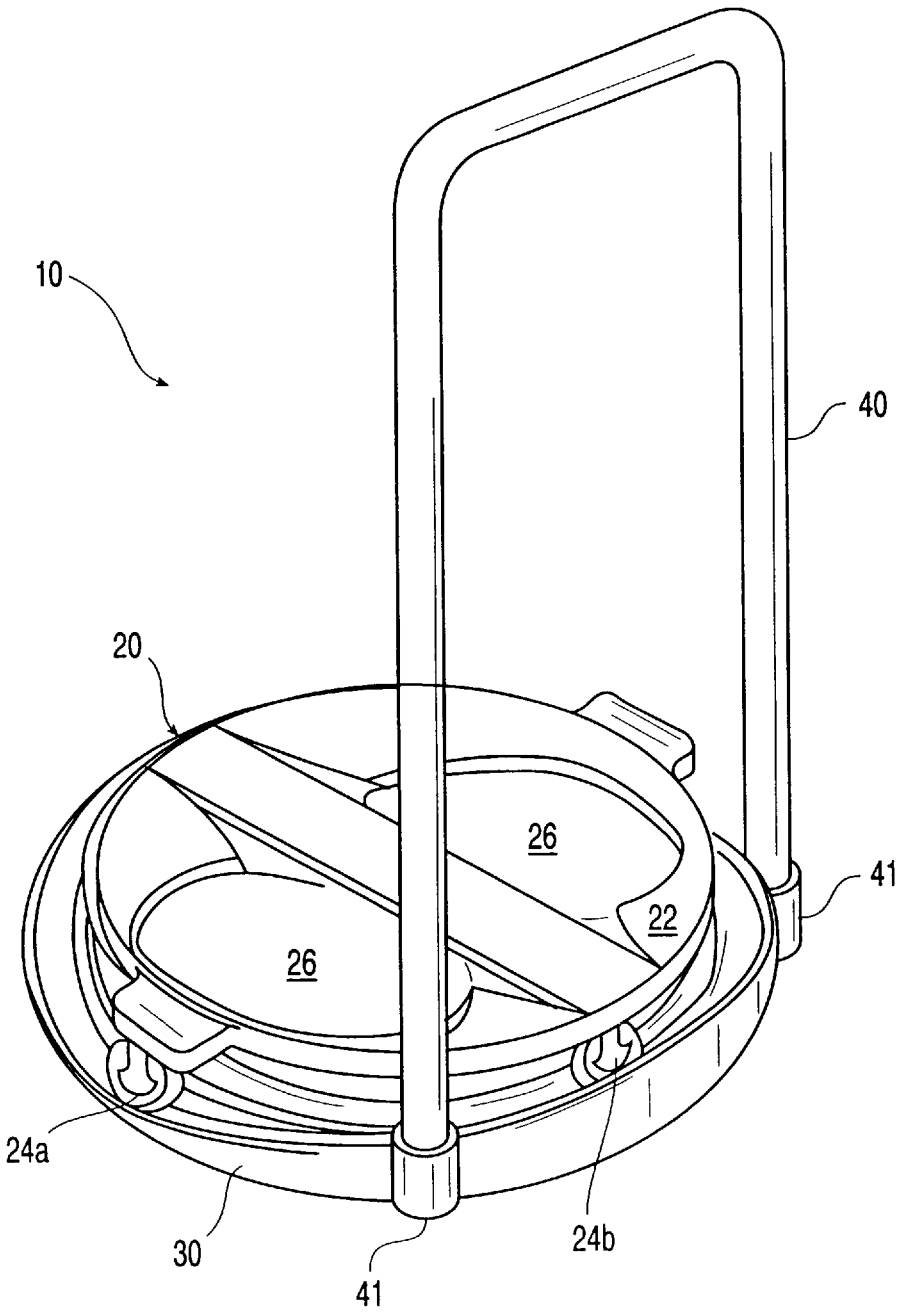
FIG. 1 is a perspective view of the exercise apparatus according to the present invention.
Figure 2:
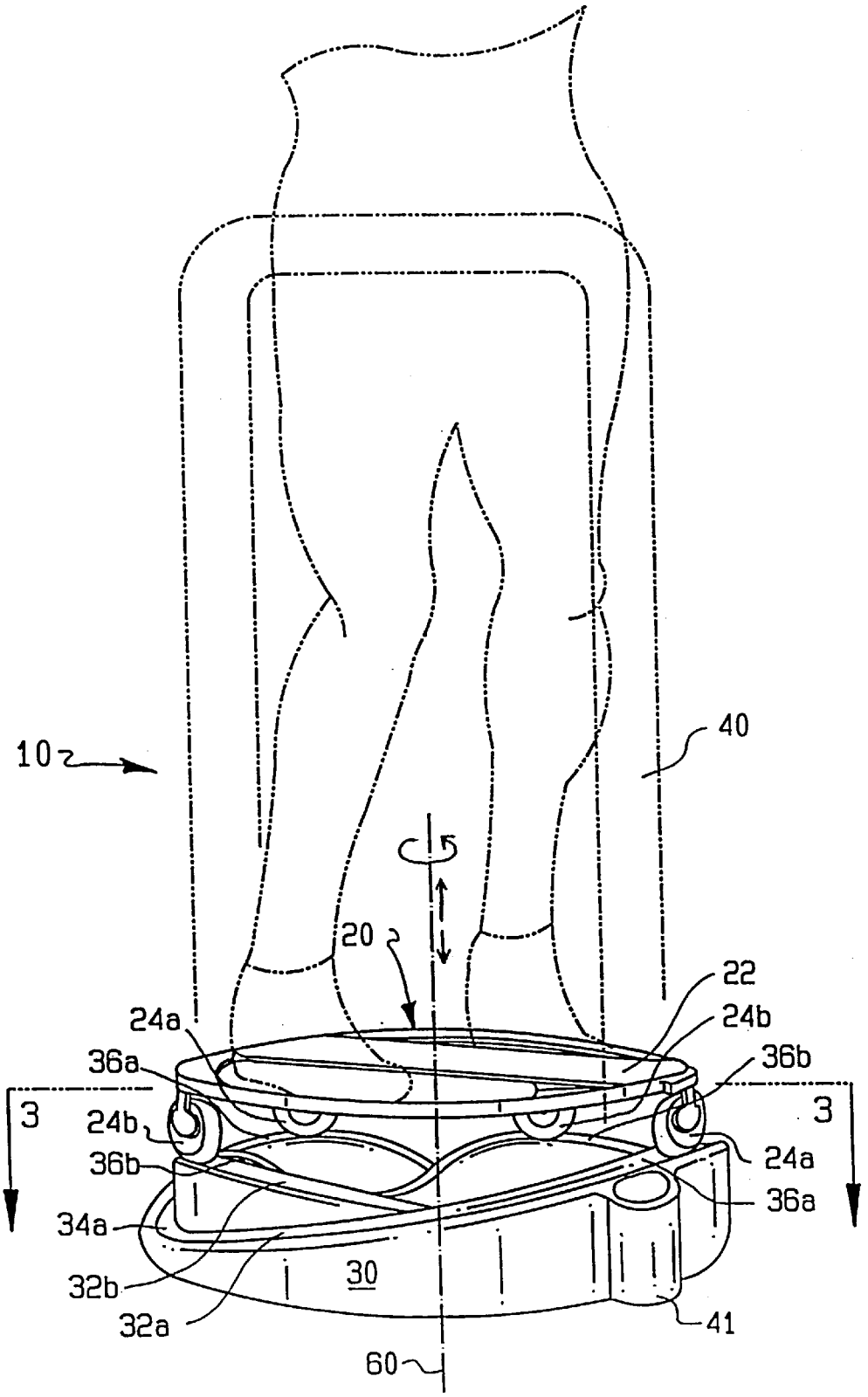
FIG. 2 is another perspective view of the exercise apparatus.
Figure 3:
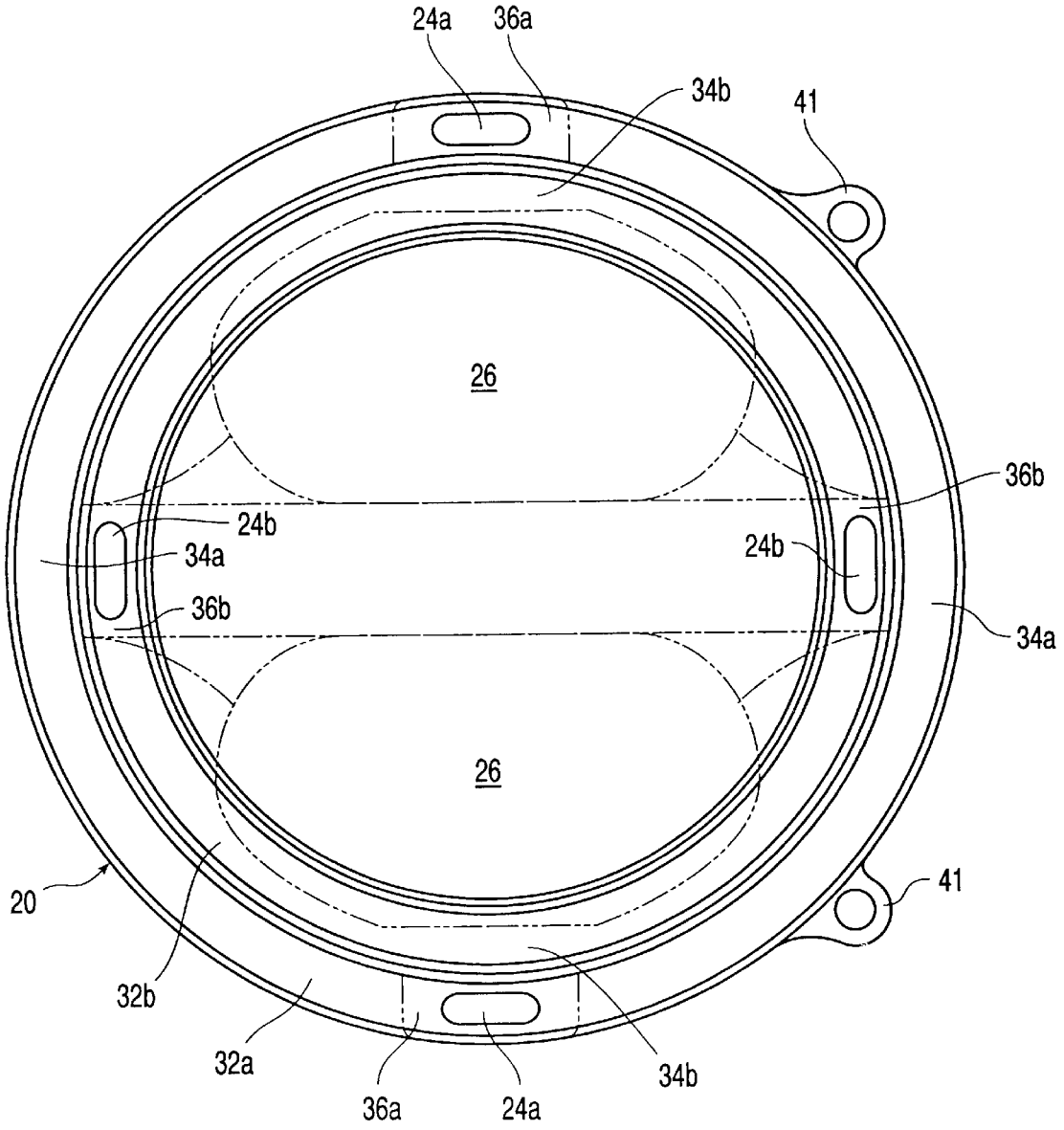
FIG. 3 is a plan view of the platform and base taken along 3—3 of FIG. 2.

Referring more particularly to the drawings, FIGS. 1–3 show a preferred embodiment of the exercise apparatus 10 according to the present invention. Exercise apparatus 10 comprises platform 20, base 30, and rail 40. Platform 20 supports a user and is adapted to concurrently rotate about an axis 60 and move vertically or linearly along axis 60 as shown in FIG. 2. As shown in FIGS. 2 and 3, base 30 has two concentric tracks 32*a*, 32*b*: a first circular closed track 32*a* at its outer periphery and a second circular closed track 32*b* just within the first closed track 32*a*. Platform 20 may be rotatably mounted to base 30 by an axle (not shown) mounted along axis 60. However, in a preferred embodiment, an axle is not required due to the stability of the four roller arrangement.

Base 30 is preferably molded in a one-piece construction, which is easy and inexpensive to manufacture. As shown in FIGS. 1 and 2, base 30 provides support for platform 20 and is configured to lie on a flat surface, such as the floor. Alternative support structures also may be provided. Indeed, any support structure may be used that is configured for attachment to any fixed structure such as a floor, wall, or ceiling. As shown in FIGS. 1 and 2, base 30 is generally cylindrical with the two closed track 32*a*, 32*b* at its outer periphery. Both tracks 32*a*, 32*b* are continuous, providing a smooth surface upon which rollers 24*a*, 24*b* glide. First or outer track 32*a* has two dips 34*a* and two crests 36*a*. Second or inner track 32*b* also has two dips 34*b* and two crests 36*b*. There is a 180° a interval between the two dips 34*a* of first track 32*a*, the two crests 36*a* of first track 32*a*, the two dips 34*b* of second track 32*b*, and the two crests 36*b* of second track 32*b*. In addition, the dips 34*a* of first track 32*a* are adjacent the crests 36*b* of second track 32*b*, and the crests 36*a* of first track 32*a* are adjacent the dips 34*b* of second track 32*b*.

Platform 20 comprises a turntable 22 and four rollers 24*a*, 24*b*. Platform 20 further comprises a pair of foot rests 26 on the top face of turntable 22. Foot rests 26 have a roughened surface to provide traction between the turntable 22 and the user's shoes or socks. The foot rests 26 take up a significant portion of the surface area of the turntable 22. They are sufficiently wide and long to accommodate feet of various sizes, and users of various heights may stand comfortably on the turntable 22 with their feet approximately a shoulder width apart. In addition, a user may place his feet closer to each other in order to increase the difficulty of the exercise or vice versa. The top face of the turntable 22 is substantially circular.

Four rollers 24*a*, 24*b*, such as in-line skate wheels, are mounted to the outer periphery of turntable 22. Both the rollers and the manner of their attachment are known in the art. In addition, more than four rollers may be used. The vertical distance between rollers 24*a*, 24*b* and turntable 22 is greater than the vertical distance between the top of crests 36*a*, 36*b* and the bottom of dips 34*a*, 34*b* so that turntable 22 does not strike base 30 as it rotates. Rollers 24*a*, 24*b* are mounted along the outer periphery of turntable 22 at 90° intervals. Two rollers 24*a* spaced 180° apart are mounted near the outer periphery of turntable 22 and glide along first track 32*a*, and two rollers 24*b* spaced 180° apart are mounted at a slight offset from the outer periphery of turntable 22 and glide along second track 32*b*. Tracks 32*a*, 32*b*, and rollers 24*a*, 24*b* are configured and mounted such that all rollers 24*a*, 24*b* are in constant contact with one of the tracks 32*a*, 32*b*. In other words, during use of the apparatus 10, rollers 24*a* mount crests 36*a* and rollers 24*b* mount crests 36*b* simultaneously, and rollers 24*a* glide into dips 34*a* and rollers 24*b* glide into dips 34*b* simultaneously. The base 30 therefore provides a stable support for the platform 20, and the turntable 22 maintains its parallel relation to the floor without tipping over.

Platform 20 is configured such that it will provide complete support to the user. Therefore, the user does not need additional support to hold his weight or to maintain his balance. However, in order to assure the user of his safety, rail 40 is provided which the user optionally may grasp during exercise. As shown in FIG. 1, rail 40 is mounted in the O-shaped mounts 41 formed on base 30. When the exercise apparatus 10 is not in use, the rail 40 may be removed from the O-shaped mounts 41. Due at least in part to this feature, the exercise apparatus 10 is compact and easy to store, making this apparatus particularly suited for home use.

In addition, a resistance means may be provided, such as are described in the parent application, which is incorporated by reference, for opposing movement of the platform. Such a resistance means will increase the difficulty of rotating the platform, thereby providing a more strenuous workout.

In order to use this apparatus, the user places his feet on foot rests 26 of platform 20, preferably about a shoulder width apart, such that he may stand steadily and comfortably on them. Initially, rollers 24*a*, 24*b* rest at the bottom of dips 34*a*, 34*b*.

Then, by exerting muscles in all areas of his body, including arms, torso and legs, the user engages in a twisting movement simultaneously with a jumping movement. The twisting and jumping movements of the user cause rollers 24*a*, 24*b* to move along first track 32*a* and second track 32*b* and up crests 36*a*, 36*b*, thereby rotating platform 20 about axis 60 and lifting platform 20 vertically or linearly along axis 60. Rollers 24*a*, 24*b* continue along tracks 32*a*, 32*b* and down dips 34*a*, 34*b*, thereby continuing to rotate platform 20 about axis 60 while lowering platform 20 linearly along axis 60. By continued exertion of the user's muscles and the inertia built up during exercise, platform 20 continues to rotate while concurrently lifting or descending.

The user may continue rotating platform 20 in one direction or may alternate rotational direction during exercise. During exercise, the user also may grasp rail 40 for additional support or to help him shift rotational directions.

Except for the relative position of his feet, a user's body is not restricted by apparatus 10. The user may stand in a variety of positions and engage in a wide variety of movements that will successfully rotate and lift platform 20. For example, he may bend at the waist, crouch or hold his arms out. This freedom contributes substantially to the enjoyment of exercising with this device.

The present invention may be embodied in other forms without departing from its spirit or essential characteristics. The described embodiments are to be considered only as illustrative and not as restrictive. The scope of the invention is, therefore, indicated by the appended claims.

What is claimed:

1. An exercise apparatus comprising:

a platform for supporting a user, wherein the platform is mounted for rotation about an axis through a point in an area defined by the platform and for concurrent linear movement along the axis and wherein the platform comprises a turntable attached to a plurality of rollers; and a base, comprising two closed tracks, for supporting the platform, wherein the rollers of the platform are adapted to glide on the two closed tracks.

2. The exercise apparatus according to claim 1, wherein each closed track has a plurality of dips and crests.

3. The exercise apparatus according to claim 2, wherein at least two rollers are adapted to glide on one of the two closed tracks and at least two other rollers are adapted to glide on the other of the two closed tracks, thereby concurrently producing rotational movement and linear movement of the platform.

4. The exercise apparatus according to claim 1 wherein the two tracks are concentric.

5. The exercise apparatus according to claim 1 further comprising resistance means for opposing movement of the platform.

6. The exercise apparatus according to claim 1 wherein a rail is detachably mounted to the base.

7. The exercise apparatus according to claim 1 wherein the base is a molded one-piece construction.

8. An exercise apparatus, comprising:

two concentric circular tracks having a varying height around the circumference of each track; and a platform adapted to support a user, said platform riding on the tracks by means of a plurality of rollers such that a twisting movement by the user on the platform causes rotation of the platform about an axis through a point in an area defined by the platform along the tracks resulting in vertical movement of the platform corresponding to the varying height of the tracks.

9. The exercise apparatus according to claim 8, further comprising:

a plurality of rollers depending downwardly from the platform to ride along the two concentric circular tracks and to support the platform, wherein each track has two dips spaced 180° apart alternating with two crests spaced 180° apart, the two dips of one track are adjacent to the two crests of the second track, the two crests of the one track are adjacent to the two dips of the second track, and the rollers are spaced 90° degrees apart, such that the rollers ride on the four crests concurrently and the four dips concurrently.

10. The exercise apparatus according to claim 9, wherein the plurality of rollers comprises at least four rollers.

11. The exercise apparatus according to claim 8, wherein the platform has a substantially planar upper surface which remains substantially perpendicular to the axis of rotation.

12. Exercise apparatus, comprising:

a base member with at least two concentric tracks having alternating dips and crests;

a platform comprising a turntable and a plurality of rollers attached to the turntable for riding on the dips and crests of the base member to provide simultaneous rotational movement about an axis through a point in an area defined by the platform and vertical movement of the platform.

13. The exercise apparatus according to claim 12, wherein the rollers are arranged on the platform to provide lateral stability of the platform.

14. An exercise apparatus, comprising:

a first circular track having around its circumference at least one pair of crests and at least one pair of dips, the dips and crests of each pair being disposed across from each other and alternating in a dip-crest-dip-crest arrangement around the circumference;

a second circular track, concentrically arranged within the first track, said second track having around its circumference at least one pair of crests and at least one pair of dips, the dips and crests of each pair being disposed across from each other and alternating in a dip-crest-dip-crest arrangement around the circumference, wherein the first track is disposed adjacent the second track such that the dips of the first track are adjacent to the crests of the second track; and a platform; and a plurality of rollers depending downwardly from the platform, the platform riding on said tracks by means of the plurality of rollers such that rotational movement of the platform also provides a vertical movement corresponding to said crests and dips.

15. An exercise apparatus, comprising:

two concentric circular tracks having a varying height around the circumference of each track;

a platform adapted to support a user; and a plurality of rollers depending downwardly from the platform to support the platform and to ride along the two concentric circular tracks such that a twisting movement by the user on the platform causes rotation of the platform and the plurality of rollers along the tracks resulting in vertical movement of the platform corresponding to the varying height of the tracks, wherein each track has two dips spaced 180° apart alternating with two crests spaced 180° apart, the two dips of one track are adjacent to the two crests of the second track, the two crests of the one track are adjacent to the two dips of the second track, and the rollers are spaced 90° degrees apart, such that the rollers ride on the four crests concurrently and the four dips concurrently.

16. The exercise apparatus according to claim 15, wherein the plurality of rollers comprises at least four rollers.

* * * * *